United States Patent [19]

Voshall et al.

[11] Patent Number: 4,709,397

[45] Date of Patent: Nov. 24, 1987

[54] TAMPER-EVIDENT ENVELOPE WITH INDICIA-FORMING COHESIVE LAYERS

[75] Inventors: Donald K. Voshall, Dunwoody; Danny K. Strickland, Jackson, both of Ga.

[73] Assignee: John H. Harland Company, Decatur, Ga.

[21] Appl. No.: 863,835

[22] Filed: May 16, 1986

Related U.S. Application Data

[63] Continuation-in-part of Ser. No. 813,037, Dec. 24, 1985.

[51] Int. Cl.[4] ..... B65D 27/14

[52] U.S. Cl. ..... 383/5; 40/630; 206/459; 206/807; 229/80; 283/101; 283/110; 428/40

[58] Field of Search ..... 383/5, 93, 116; 229/80, 229/81, 83, 48 SA; 206/459, 613, 807; 40/625, 626, 630, 2 R; 428/202, 203, 915, 40; 283/94, 101, 109, 110

[56] References Cited

U.S. PATENT DOCUMENTS

| | | | |
|---|---|---|---|
| 2,128,196 | 8/1938 | Vogel | 229/81 |
| 2,131,575 | 9/1938 | Whipple | 229/80 |
| 2,259,822 | 10/1941 | Kienlen | 229/80 |
| 2,409,100 | 10/1946 | Brady et al. | 383/93 |
| 3,217,871 | 11/1965 | Lee | 229/80 |
| 3,666,926 | 5/1972 | Conte, Jr. et al. | 229/80 |
| 3,675,844 | 7/1972 | Sorrell | 229/80 |
| 3,891,242 | 6/1975 | Arnold et al. | 40/676 X |
| 3,923,198 | 12/1975 | Brochman | 220/359 |
| 3,933,304 | 1/1976 | Judd | 383/5 |
| 4,028,165 | 6/1977 | Rosenfeld | 428/203 X |
| 4,082,873 | 4/1978 | Williams | 428/40 |
| 4,121,003 | 10/1978 | Williams | 428/40 |
| 4,180,929 | 1/1980 | Schultz, Jr. | 40/2 R |
| 4,197,947 | 4/1980 | Zaido | 206/807 X |
| 4,468,811 | 8/1984 | Shaw et al. | 383/5 |
| 4,509,196 | 4/1985 | Sak et al. | 383/5 |
| 4,510,621 | 4/1985 | Sak et al. | 206/807 X |
| 4,566,627 | 1/1986 | Gendron | 229/81 |

FOREIGN PATENT DOCUMENTS

| | | | |
|---|---|---|---|
| 2340810 | 8/1973 | Fed. Rep. of Germany | 283/101 |

*Primary Examiner*—Stephen Marcus
*Assistant Examiner*—Bryon Gehman
*Attorney, Agent, or Firm*—Jones, Askew & Lunsford

[57] ABSTRACT

An envelope with a pressure sensitive seal containing a hidden printed message which is revealed when the seal has been opened. The unsealed edges of the envelope each have an anchor coating covered by a cohesive layer. The message is formed by voids in the cohesive layer on one edge. Cohesive layers adhere to the anchor coatings on both edges, and seal the envelope as desired. The cohesive layers have a stronger affinity for each other than for the anchor coating. The message is revealed as the cohesive layer containing voids separates from the anchor coating causing the disruption of the anchor coating, when the sealed envelope is opened.

12 Claims, 5 Drawing Figures

TAMPER-EVIDENT ENVELOPE WITH INDICIA-FORMING COHESIVE LAYERS

RELATED U.S. APPLICATIONS

This is a Continuation-In-Part of U.S. patent application Ser. No. 813,037 field Dec. 24, 1985.

TECHNICAL FIELD

The present invention relates to a tamper-evident envelope with a pressure sensitive seal, and more particularly to an envelope which reveals a printed message when its seal has been broken.

BACKGROUND OF THE INVENTION

Envelopes of various types have been devised to provide for the security of the contents held within. The greatest disadvantage of these envelopes is that they can be opened and resealed without the knowledge of the recipient. The contents can therefore be accessed, partially removed or altered in such a way that the recipient will not be aware of such a tampering until a much later date, if at all. It is common knowledge that conventional paper envelopes can be easily opened with steam. The glue of the opened envelope may then be moistened and the envelope resealed, leaving no evidence of tampering. Even the more secure plastic envelopes can be opened with solvents which dissolve the seal. The contents of these higher security plastic envelopes can then be accessed and the envelopes resealed with the application of additional glue or cement, without alerting the recipient.

Bank night-depository envelopes are particularly vulnerable to security risks. Endorsed checks are inserted by the customer into an envelope which is handled by several persons until opened by a bank official who is unfamiliar with the original contents. Therefore, several checks may be removed without detection during the handling process, and discrepancies will not be evident until the depositor obtains the receipt.

Currently, the most common bank deposit security container consists of a cloth bag with a lockable zippered closure. One key to the bag is kept by the depositor and an additional key is maintained by the recipient such as a bank official. Unfortunately, such locks are not always secure, and if the lock is opened and the contents of the zippered bag removed or altered, the recipient will have no notice of the tampering until a discrepancy is discovered.

A bank depository bag was devised by Judd (U.S. Pat. No. 3,933,304) to protect against unauthorized invasions by printing information, such as the name of the bank, on the two heat-sealed edges of the bag. The heat-seal is located between the edge containing the printed information and the contents of the bag so that access to the bag can only be achieved by cutting the heat sealed edge, thus removing the printed information. If the bag is opened and resealed, the absence of the printed information is intended to alert the recipient to check for missing documents. One disadvantage to this device and other similarly sealing envelopes and packages is that heat-sealing equipment must be available to the person placing the contents in the bag. This creates an inconvenience and additional expense.

A high integrity tamper-resistant container secured by a permanent pressure sensitive seal was devised by Whelan (U.S. Pat. No. 4,483,018). Although this container is difficult to access and reseal without leaving evidence of an unauthorized entry, it is possible to compromise the security features of this container by cutting the envelope along one of the two heat-sealed edges, removing the contents and resealing the cut edge with heat. The detection of such an unauthorized access would be difficult for most recipients because the tamper-indicating border does not extend to the heat-sealed edges.

The personnel receiving any of the above-mentioned sealed envelopes must be educated on how to detect any unauthorized opening or must have an unopened envelope available for comparison.

Consequently, there is an immediate need for an inexpensive, tamper-evident envelope which indicates on its face that the seal has been broken.

SUMMARY OF THE INVENTION

In accordance with the present invention, a tamper-evident envelope is provided. The envelope is sealed with a pressure sensitive seal which may be reopened. However, any opening is readily detected by the appearance of a printed message indicating that the seal has been broken.

Stated somewhat more particularly, the envelope is made from one or two sheets of flexible material such as plastic or the like, sealed along an end edge and two side edges. The remaining edge, through which checks or other papers are inserted, is coated on its upper and lower inner surfaces with a translucent or opaque substance, providing a textured surface to which a cohesive layer will anchor. This anchor coating is applied continuously over both the upper and lower surfaces. Cohesive layers are then adhered to the anchor coatings on both the upper and lower inner surfaces of the envelope. The lower cohesive layer is imprinted in a pattern with voids which create a reverse drop-out message. A separating strip of adhesive-releasable material is inserted between the two cohesive layers to prevent unintentional sealing.

After documents have been inserted into the envelope, the separating strip is removed or detached and the cohesive layers are pressed together to form a translucent or opaque seal which hides the message from view. The envelope can be reopened by pulling the two sheets of plastic away from each other along the pressure senstivie seal. However, because the two cohesive layers have a very strong affinity for each other, the cohesive layers remain permanently joined to each other and must be pulled from an anchor coating. The cohesive layer containing void regions will have less surface area in contact with the anchor coating; therefore, most of the patterned cohesive layer will be pulled away from the anchor coating. The action of pulling the patterned cohesive from the anchor coating causes a disturbance of the anchor coating causing the anchor coating to appear cloudy. The portions of the anchor coating beneath the void regions of the cohesive layer are not disturbed and remain relatively clear, creating the reverse drop-out message. This message will be instantly observable by anyone handling the envelope, even if an attempt has been made to reseal the envelope.

Accordingly, it is an object of the present invention to provide an improved envelope which is tamper-evident.

Another object of the present invention is to provide a tamper-evident envelope which is easily sealed without the use of expensive heat-sealing equipment.

A further object of the present invention is to provide a tamper-evident envelope which does not require the education of personnel to determine whether or not the seal has been broken.

These and other objects, features and advantages of the present invention will become apparent after a review of the following detailed description of the disclosed embodiment when taken in conjunction with the appended claims.

DETAILED DESCRIPTION OF THE DISCLOSED EMBODIMENT

Figure 1:
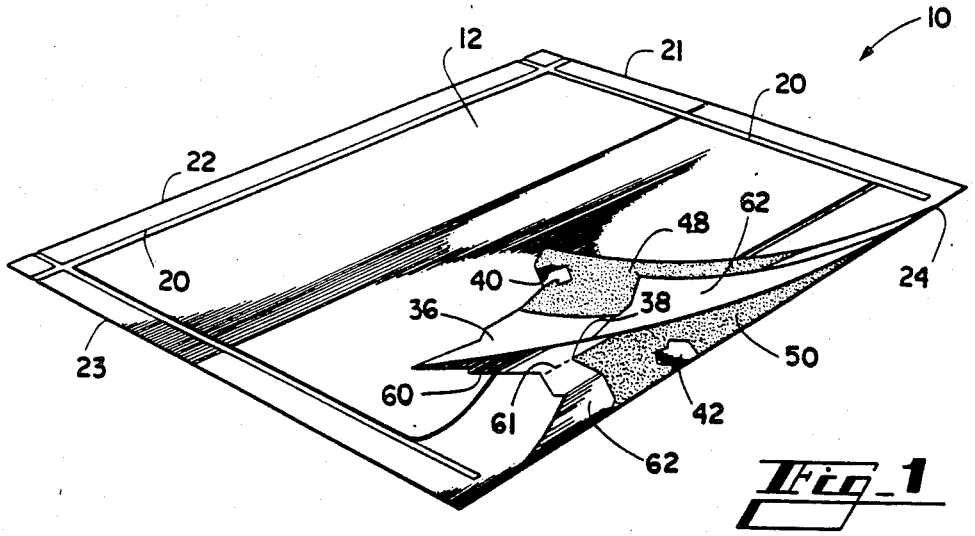
FIG. 1 is a pictorial view of an unsealed tamper-evident envelope, shown partially cut away for illustration, embodying the present invention.

As shown best in FIG. 1, the preferred embodiment of the present invention comprises an envelope 10 formed from a single rectangular sheet of coextruded thermoplastic film which is folded approximately in half. Alternatively, the envelope may be made from two rectangular sheets of plastic of approximately the same size, heat-sealed or otherwise bonded together along three sides to form an envelope. The envelope could also be made in any other shape, such as a circle or triangle, providing that there is sufficient overlap of the upper and lower sheets to form a sealed perimeter.

The thermoplastic material may be printed with a layer of color on the upper and lower sheets, so that the center portion 12 of the envelope appears opaque, concealing the contents from view. In addition, a strip of paper 60 may be contained within the envelope as an opaque barrier to further conceal the contents of the envelope. It could be possible to make the envelope out of another material which is impact-resistant, such as paper; however, plastic is preferred because it is waterproof and resilient.

In the preferred embodiment of the present invention, the envelope 10 is formed from a single rectangular sheet folded in half along a lengthwise edge 22 to form an upper sheet 36 and a lower sheet 38. These upper and lower sheets are continuously heat-sealed at 20 along the side edges 21 and 23 and the folded edge 22, leaving one edge 24 unsealed for inserting the contents of the envelope. In the preferred embodiment of the present invention, the heat seal 20 is either spaced inwardly approximately one-half inch from the two side edges 21 and 23 and the bottom folded edge 22, or a full one-half inch heat seal is applied to the two side edges 21 and 23 and the bottom folded edge 22.

Figure 2:
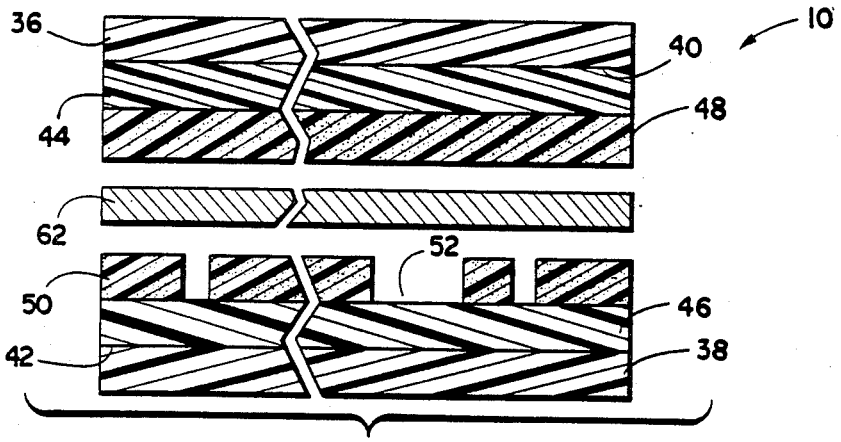
FIG. 2 is an exploded cross-section view of the presealed open edge of the envelope shown in FIG. 1, enlarged along the vertical axis for illustration.
Figure 3:
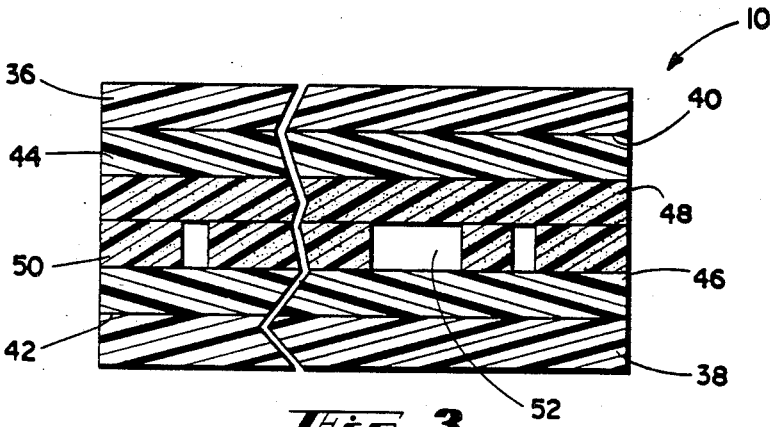
FIG. 3 is a cross-section view as in FIG. 2, except that the open edge of the envelope is shown sealed.

The confronting upper and lower inner surfaces 40 and 42 of the upper sheet 36 and the lower sheet 38, along the unsealed edge 24, are each coated continuously with anchor coatings 44 and 46, as shown in FIGS. 2 and 3. The anchor coating 46 can also be applied around the entire perimeter of the envelope on the upper and lower thermoplastic sheets 36 and 38 between the heat-seal 20 and the external edges 21 and 23 of the envelope at 47.

Cohesive layers 48 and 50 are applied over the anchor coatings 44 and 46 on both the upper and lower inner surfaces 40 and 42 of the sealing edge 24 and the remaining unsealed perimeter of the envelope at 47, again as best shown in FIGS. 2 and 3. The cohesive layer 48 on the upper inner surface 40 of the envelope is applied continuously, but the cohesive layer 50 on the lower inner surface 42 is applied non-continuously in such a way that the absence of coating creates voids 52 which appear as a reverse drop-out pattern. In the preferred embodiment, the voids 52 create a pattern in the image of letters which are arranged to form a repeating statement 54 such as "SEAL BROKEN" on the lower inner surface 42, as shown best in FIG. 5. In addition, the cohesive layer 50 is applied in a repeating, diagonal-line pattern 55 as a border around the printed message 54 at 56 and 58. The cohesive layer 50 can also be applied non-continuously at 47 around the perimeter of the lower thermoplastic sheet 38 to create the diagonal-line pattern 55. In addition, the cohesive layer 50 could be applied non-continuously at 47 to create both the diagonal-line pattern 55 and the reverse drop-out message "SEAL BROKEN" 54.

It will be understood by those skilled in the art that the cohesive layer could be applied non-continuously on either the lower inner surface 42 as shown, or the upper inner surface 40.

The cohesive layer and the anchor coating are carefully matched to achieve the desired amount of adhesion. In the present invention, the cohesive layers 48 and 50 must have a greater affinity for each other than for the anchor coatings 44 and 46. The preferred anchor coating was developed by combining a styrene acrylic copolymer and polyvinyl acetate with a volatile solvent. The preferred cohesive is "Quick Stick" brand, a commercial soft, water-based latex emulsion manufactured by the Quick Wrap Company of Birmingham, Ala.

In the preferred embodiment of the present invention, a folded, elongated strip of paper 60 is positioned within the envelope 10 so that a portion 62 of the strip lies between the two cohesive layers 48 and 50, as shown in FIG. 2, preventing cohesion until the envelope is ready to be sealed. The entire paper strip 60 is contained within the envelope 10 and is perforated or scored as at 61 so that the strip portion 62 located immediately between the cohesive layers 48 and 50 can be torn away and discarded, allowing the cohesive layers to be pressed together to form the seal 52 as shown in FIG. 3, and leaving the remaining paper strip in the envelope to conceal the contents from view on both the top and bottom of the envelope. Alternatively, the paper strip 60 can be perforated yet unfolded, so that after the strip portion 62 is removed, the contents are concealed from view on only one side of the envelope. The paper strip 60 can also be a single sheet which is entirely removed from the envelope before the envelope is sealed.

When the seal 52 is formed and is intact, the "SEAL BROKEN" message 54 and the diagonal-line pattern 55 are substantially hidden. The voids 52 are masked by the two translucent anchor coatings 44 and 46 and the translucent cohesive layer 48 on the upper inner surface 40 of the envelope, as shown best in FIG. 3. The cohesive layers 48 and 50 are each translucent, textured and slightly pliable. When the cohesive layers 48 and 50 are pressed together to form the seal 52, the translucent quality of each cohesive layer is enhanced. Because the anchor coatings 44 and 46 are also translucent, the cumulative effect of the seal 52 is to substantially obscure the message 54 and pattern 55.

Figure 5:
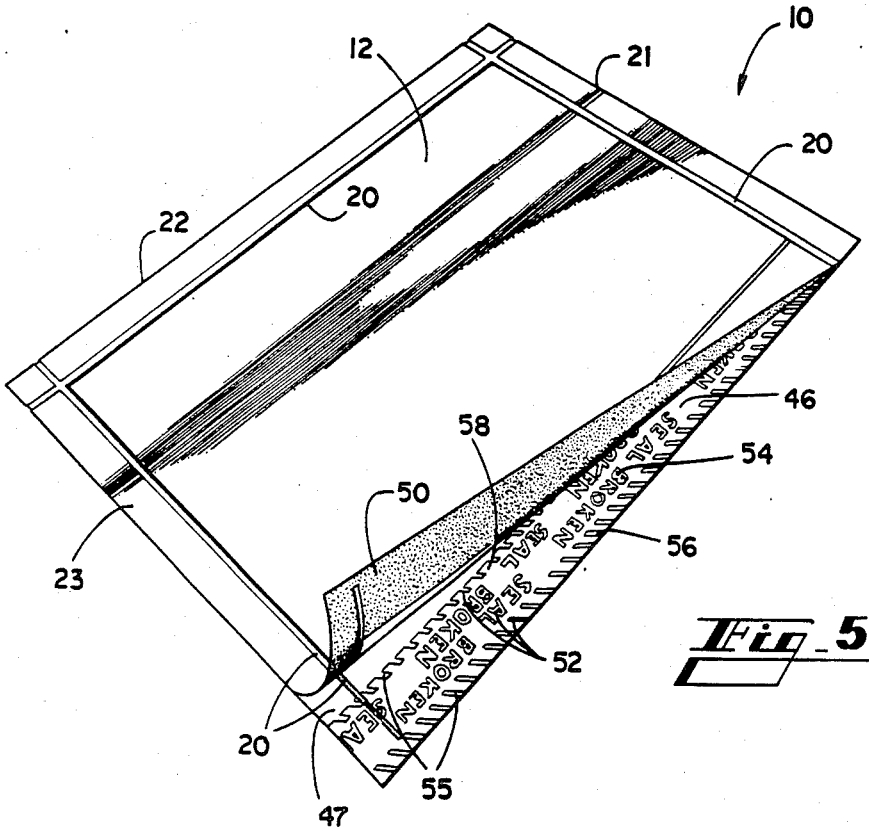
FIG. 5 is a pictorial view of the disclosed tamper-evident envelope after the seal is opened.
Figure 4:
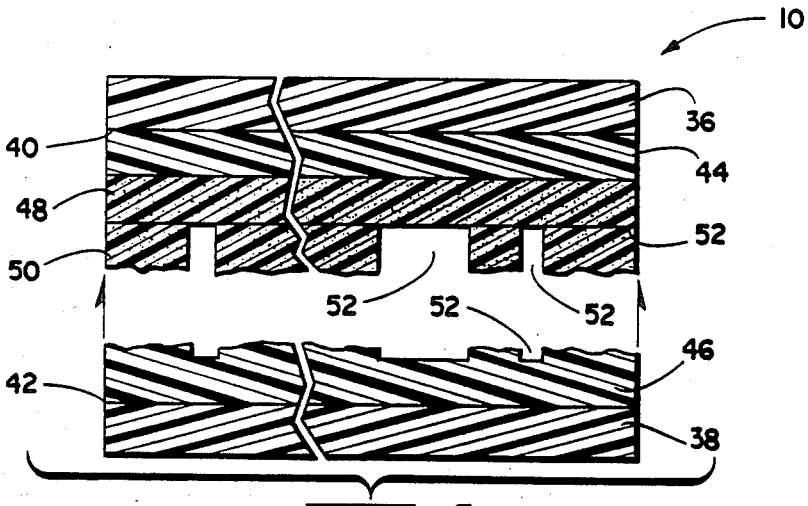
FIG. 4 is an exploded cross-section view as in FIG. 3, showing the disclosed envelope after the sealed edge is opened.

The mechanism by which the "SEAL BROKEN" message 54 is revealed is as follows. Once the seal has been formed, the two cohesive layers 48 and 50 become inseparable because these layers have a greater affinity for each other than for the anchor coating layers 44 and 46. Both cohesive layers will favor the upper inner surface 40 of the envelope because the upper anchor coating 44 is continuously covered with the cohesive layer 48, and therefore has a greater surface area of cohesive, while the lower anchor coating 46 is only partially covered by the cohesive layer 50 because of the void regions defining the message 54 and the pattern 55. As the lower cohesive layer 50 pulls away from the anchor coating 46, the surface of the anchor coating is disturbed and becomes cloudy. The anchor coating 46 beneath the void regions 52 of the cohesive layer 50 is not disturbed and therefore remains relatively clear. The removal of the cohesive layer 50 from the lower anchor coating 46 thus causes the reverse drop-out message 54 and diagonal-line pattern 55 to appear on the anchor coating 46 where the message and pattern are readily observed as shown in FIGS. 4 and 5.

Once the seal 52 has been broken, the two cohesive layers 48 and 50 cannot be re-adhered to the lower anchor coating 46, and the "SEAL BROKEN" message 54 and the pattern 55 are visible to anyone handling the envelope.

While this invention has been described with particular reference to a preferred embodiment thereof, it will be understood that variations and modifications can be effected within the spirit and scope of the invention as described hereinbefore and as defined in the appended claims.

We claim:

1. A tamper-evident envelope, comprising:

(a) a pouch formed from at least one sheet of impact resistant material, said pouch having a plurality of edges sealed along all but one remaining edge;

(b) said remaining edge defining an access opening through which items can be placed into said pouch:

(c) said remaining edge having upper and lower inner surfaces;

(d) said upper inner surface being covered with a translucent upper anchor coating, and said lower inner surface being covered with a translucent lower anchor coating;

(e) said upper anchor coating being covered with a cohesive layer;

(f) said lower anchor coating being covered with said cohesive layer in a predetermined pattern bearing characteristic indicia, so that when said cohesive layers of said remaining edge are pressed together, a translucent seal closing the pouch is formed obscuring said characteristic indicia;

(g) said cohesive layer on the lower inner surface being interrupted by predetermined void regions, said void regions defining said indicia which convey a message that the seal has been broken; and (h) said cohesive layers having a greater affinity for each other than for the anchor coatings and the affinity between said interrupted cohesive layer on said lower surface and said anchor coating being less than the affinity between said non-interrupted cohesive layer on said upper surface and said anchor coating, so that said cohesive layer covering said anchor coating on said lower inner surface is pulled away from said anchor coating to reveal said indicia when said inner surfaces are separated after being cohesively sealed, whereby any attempt to break said translucent seal results in the disruption of said cohesive layers and said anchor coatings causing said characteristic indicia to be revealed.

2. The envelope of claim 1, wherein the act of pulling said cohesive layer from said anchor coating causes the disruption of said anchor coating.

3. The envelope of claim 2, wherein said anchor coating beneath said predetermined void regions is not disrupted.

4. The envelope of claim 3 further comprising a removable means interposed between the cohesive layers to prevent cohesion before sealing.

5. The envelope of claim 1, wherein at least one of said cohesive layers is translucent.

6. The envelope of claim 5, wherein said cohesive layer is a preparation comprising a soft latex.

7. The envelope of claim 1, wherein said translucent anchor coating is a preparation comprising an acrylic copolymer and polyvinyl acetate.

8. A tamper-evident envelope, comprising:

(a) a pouch formed from at least one sheet of pliable film, said pouch having a plurality of edges sealed along all but one remaining edge;

(b) said remaining edge defining an access opening through which items can be placed into said pouch;

(c) said remaining edge having mutually confronting inner surfaces;

(d) anchor coatings covering each of said inner surfaces of said remaining edge, at least one of said anchor coatings being translucent;

(e) cohesive layers covering each of said anchor coatings;

(f) at least one of said anchor coatings being covered with said cohesive layer in a predetermined pattern bearing characteristic indicia, so that when said cohesive layers of said remaining edge are pressed together, a translucent seal closing the pouch is formed; and (g) said cohesive layers having a greater affinity for each other than for said anchor coatings, and the affinity between said patterned cohesive layer and said anchor coating being less than the affinity between said non-patterned cohesive layer and said anchor coating, whereby any attempt to break said translucent seal results in the disruption of said anchor coating and said cohesive layers as said patterned cohesive layer is pulled away from said anchor coating causing the exposure of said characteristic indicia.

9. The envelope of claim 8, wherein said translucent anchor coating is a preparation comprising an acrylic copolymer and polyvinyl acetate.

10. The envelope of claim 8, wherein at least one of said cohesive layers is translucent.

11. The envelope of claim 10, wherein said cohesive layer is a preparation comprising a soft latex.

12. The envelope of claim 10, further comprising a removable means interposed between the cohesive layers to prevent cohesion before sealing.

* * * * *